US007275653B2

(12) United States Patent
Tedford, Jr.

(10) Patent No.: US 7,275,653 B2
(45) Date of Patent: Oct. 2, 2007

(54) RECLOSABLE CONTAINER LID

(75) Inventor: Richard A. Tedford, Jr., Loveland, OH (US)

(73) Assignee: International Paper Company, Memphis, TN (US)

( * ) Notice: Subject to any disclaimer, the term of this patent is extended or adjusted under 35 U.S.C. 154(b) by 58 days.

(21) Appl. No.: 11/076,814

(22) Filed: Mar. 10, 2005

(65) Prior Publication Data

US 2006/0201945 A1 Sep. 14, 2006

(51) Int. Cl.
*B65D 43/20* (2006.01)

(52) U.S. Cl. ..... 220/254.9

(58) Field of Classification Search ..... 220/713, 220/711, 254.4, 254.9, 345.1, 345.2, 717; 229/404, 906.1

See application file for complete search history.

(56) References Cited

U.S. PATENT DOCUMENTS 4,127,212 A * 11/1978 Waterbury ..... 220/255.1
4,570,817 A * 2/1986 Hambleton et al. ..... 220/345.2
4,819,829 A * 4/1989 Rosten et al. ..... 220/345.3
5,086,941 A * 2/1992 English et al. ..... 220/345.2
6,732,875 B2 5/2004 Smith et al.
2006/0081633 A1 * 4/2006 Schmidtner et al. ..... 220/254.9

* cited by examiner

*Primary Examiner*—Stephen J. Castellano
(74) *Attorney, Agent, or Firm*—Matthew M. Eslami

(57) ABSTRACT

A reclosable lid for use with an open-top container is disclosed. The reclosable container lid comprises a cover including an annular top wall having a channel integrally formed therein. A drinking spout in the top wall is adapted to dispense the contents of the container. The reclosable lid uses a slide lock closure feature that prevents spillage during transportation of the open-top container and easy access for opening and drinking. The slide lock closure is configured to engage with the channel to slide longitudinally along the channel between a first position and a second position. In the first position, the slide lock closure opens the drinking spout and in the second position, the slide lock closure closes the drinking spout to inhibit dispensing the contents of the container.

30 Claims, 5 Drawing Sheets

RECLOSABLE CONTAINER LID

FIELD OF THE INVENTION

This invention relates generally to plastic container lids. More particularly, this invention relates to a slidable reclosable container lid for use with a drink container.

BACKGROUND OF THE INVENTION

Containers lids for beverages and other substances intended for consumer products are well known. The container lids include a drinking spout that is adapted to permit the flow of the container contents through the drinking spout. Generally, such container lids are formed from a fusible plastic sheet material, and are designed to snap-fit over the top of the containers (i.e., cups) to keep the liquid contents from spilling during transport.

Existing container lid designs suffer from a number of problems including untimely spillage through the drinking spout due to the lack of a reliable means for sealing the drinking spout. The inability to effectively seal the drinking spout can also result in a significant loss of heat from the container contents through the drinking spout. To address these and other problems, a number of lid designs include a movable cover portion for the opening. However, most existing movable covers lack structural integrity and as a result, do not effectively seal the opening. Also, a number of movable covers are difficult to operate due to their complex design. In addition, a vast majority of movable covers interfere with a user consuming the container contents through the opening.

Therefore, there is a need for a reclosable container lid that reliably seals the drinking spout. In addition, there is a need for such a lid that is efficiently nestable for shipment in sleeves to wholesale customer, to maintain a raised lip for comfortable drinking, and to permit stacking of filled cups by a user.

SUMMARY OF THE INVENTION

The invention relates to a reclosable lid for use with an open-top container. The lid uses a slide lock closure feature that prevents spillage during transportation of the lidded cup and easy access for opening and drinking.

Accordingly, the present invention relates to a reclosable container lid comprising a cover including an annular top wall having a channel integrally formed therein. A drinking spout in the top wall is adapted to dispense the contents of the container. A side wall is extended from the top wall. A lower portion of the side wall is defining a mounting portion for sealingly attaching the lid to a container. A slide lock closure is configured to engage with a channel to slide longitudinally along the channel between a first position and a second position. In the first position, the slide lock closure opens the drinking spout. In the second position, the slide lock closure closes the drinking spout to inhibit dispensing the contents of the container.

In accordance with another aspect of the invention, a reclosable container lid comprising a cover including an annular top wall having a channel integrally formed therein. A drinking spout in the top wall is adapted to dispense the contents of the container. A side wall is extended from the top wall. A lower portion of the side wall is defining a mounting portion for sealingly attaching the lid to a container. A slide lock closure comprises a lower step segment having a key depending downwardly therefrom. The key is suitably receivable by the channel of the lid to permit movement of the slide lock closure between an open position and a closed position. An upper step segment integrally connected to the lower step segment by a resilient bridge having a plug depending downwardly therefrom. The plug is sealingly receivable by the drinking spout in the lid when the slide lock closure is in the closed position.

In accordance with one further aspect of the invention, a lid for use with a container comprising a cover having a channel integrally formed therein. The cover comprises a drinking spout adapted to dispense the contents of the container. A slide lock closure is configured to engage with the channel to slide longitudinally along the channel between a first position and a second position. In the first position, the slide lock closure opens the drinking spout and in the second position, the slide lock closure closes the drinking spout to inhibit dispensing the contents of the container.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE INVENTION

Figure 1:
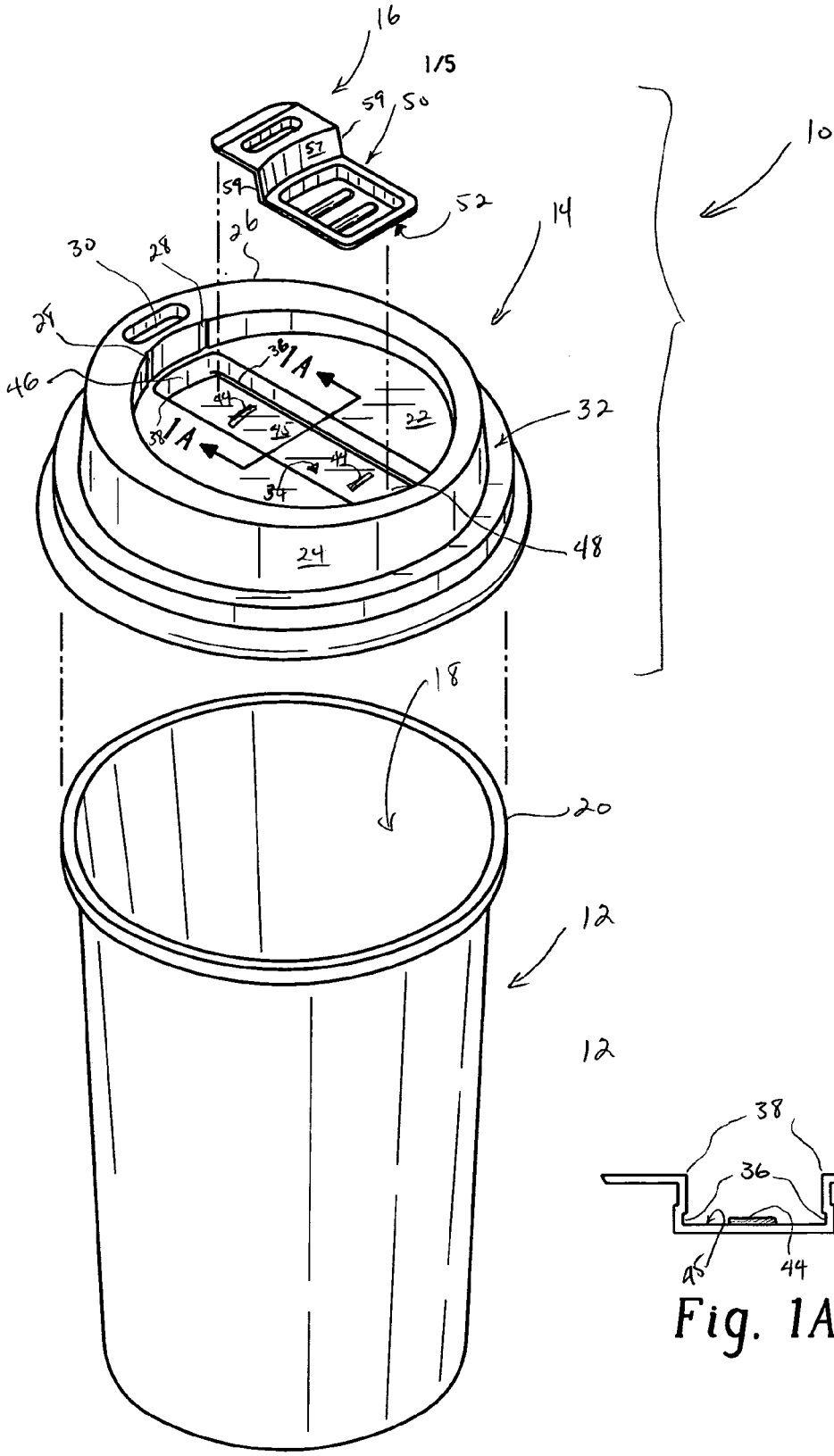
FIG. 1 is an exploded perspective view of an open-top container and a reclosable container lid having a slide lock closure wherein reclosable container lid is adapted to be used with the open-top container in accordance with the preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 is an exploded perspective view of a reclosable container lid 10 adapted to be used with an open-top container 12 in accordance with the preferred embodiment of the present invention. The reclosable container lid 10 includes a cover 14 and a removable slide lock closure 16 adapted to be used with the cover 14 to enclose an open-top container 12. The open-top container 12 defines a volume that can be used to hold or contain a flowable substance, for example a liquid or a powder. The open-top container 12 and the reclosable container lid 10 can be of either the disposable or extended use variety. The cover 14 of the reclosable container lid 10 is adapted to span the opening 18 in the upper portion of the container 12 that is generally defined by an upper rim 20 of the container 12. For illustrative purposes, the open-top container 12 could be a coffee or beverage cup.

The cover 14 has an annular top wall 22 and a side wall 24 extending from the top wall 22. Although the top wall 22 is shown as having a generally flat upper surface 22, the upper surface can be curved or angled. The cover 14 comprises a raised rim 26 that is formed by the annular top wall 22 and the side wall 24. The raised rim 26 includes a pair of guideway 28 to engage with the slide lock closure 16. A drinking spout 30 is disposed on the raised rim 26. The drinking spout 30 is adapted to dispense the contents of the open-top container 12. A lower portion of the side wall 24 is defining a mounting portion 32 for sealingly attaching the reclosable container lid 10 to the container 12. The mounting portion 32 is adapted to snap fit the reclosable container lid 10 to the open-top container 12 in a manner that seals the container 12. The side wall surface 24 can be curved or generally flat. The overall shape of the cover 14 is generally frustaconical; however, the cover 14 can have a number of other configurations.

Figure 1A:
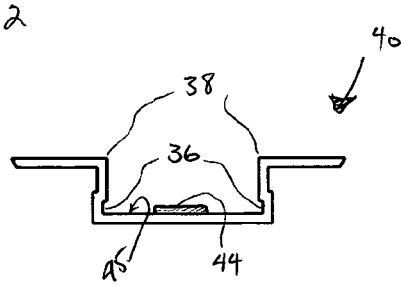
FIG. 1A is a cross sectional view of a portion of FIG. 1 taken along section lines A-A of FIG. 1.
Figure 2:
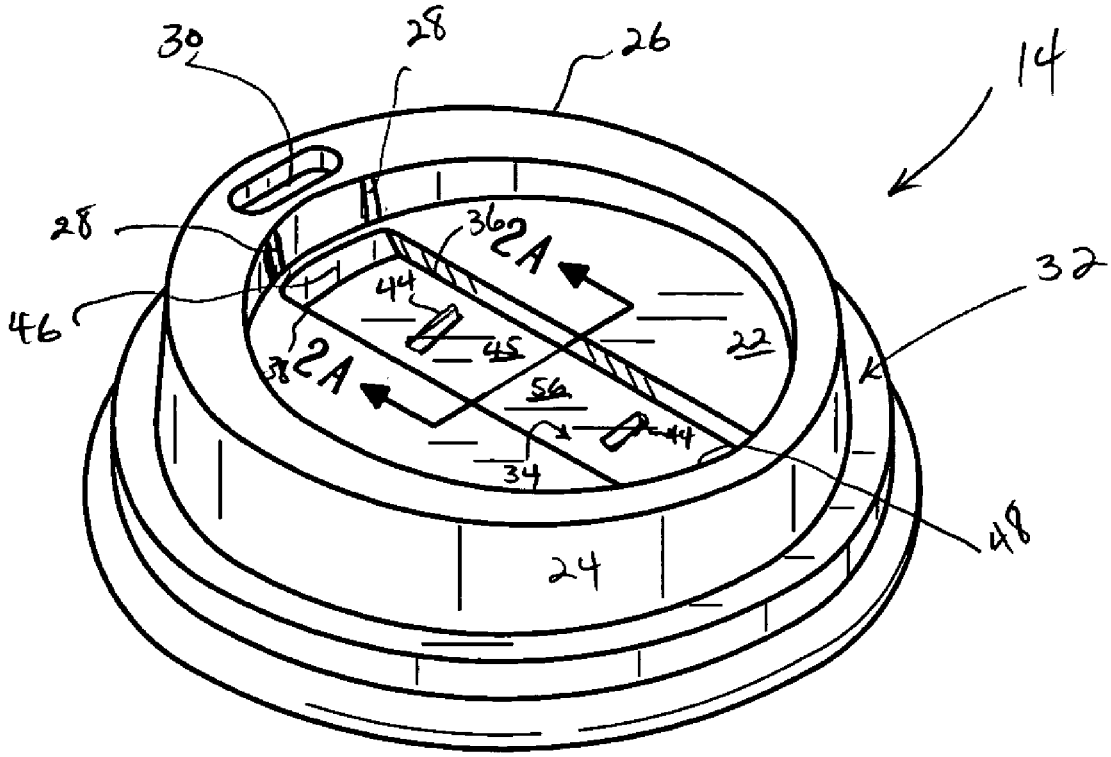
FIG. 2 is a perspective view of the reclosable container lid in FIG. 1 having an alternative embodiment.
Figure 2A:
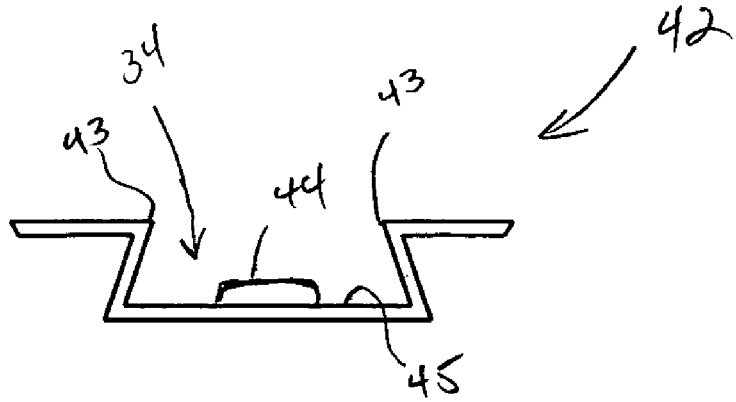
FIG. 2A is a cross sectional view of a portion of FIG. 2 taken along section lines 2A-2A of FIG. 2.

A channel 34 is integrally formed in the central portion of the annular top wall 22. The channel 34 includes a pair of guideway 36 configured to engage with the slide lock closure 16. Each of the guideways 36 is located on the longitudinal side of the channel 34. The channel 34 includes an edge 38 that defines the shape of the channel 34. In FIGS. 1A and 2A, the cross sections of the channel 34 are rectangular shape 40 and angled shape 42 respectively. The angled shaped cross section 42 is defined by edges 43. The channel 34 can have variety of cross sectional shapes, including but not limited to rectangular, square, circular, and obround. The channel 34 may alternatively includes a plurality of raised bumps 44 spaced apart from one another in a bottom surface 45 of the channel 34 between a first end 46 and a second end 48. The slide lock closure 16 is lockingly positionable at each of the raised bump 44. The slide lock closure 16 is snap-fit into the channel 34 for movement therealong. This aspect of the present invention will be described below in greater detail.

Figure 4:
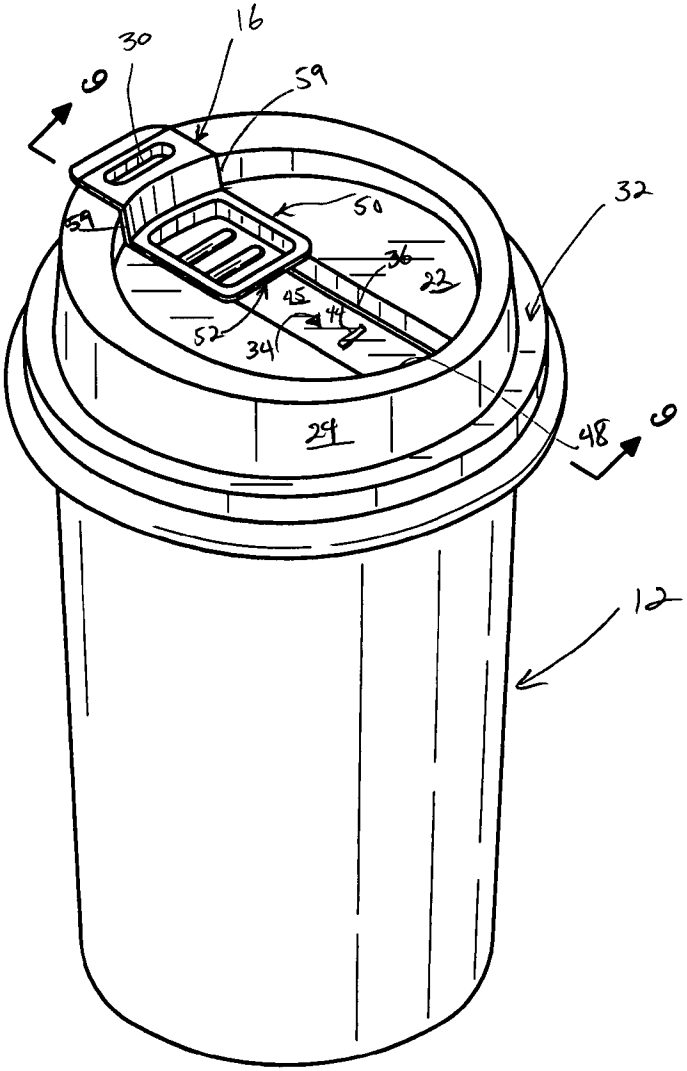
FIG. 4 is similar to FIG. 1 illustrating the reclosable container lid including the slide lock closure engaged with and the open-top container in a closed position.
Figure 3:
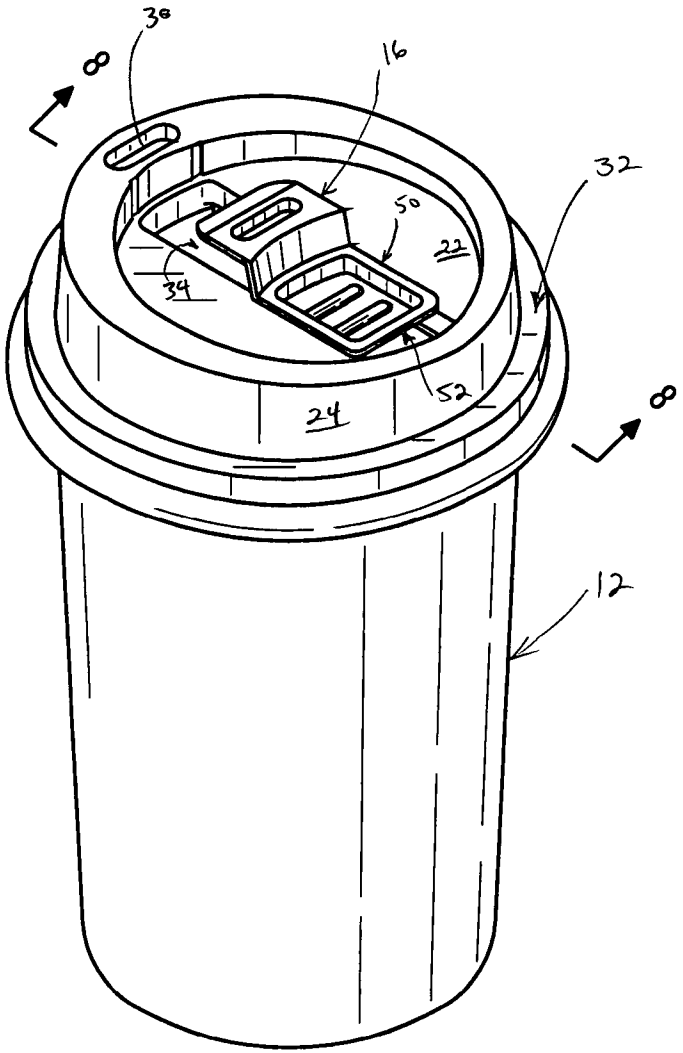
FIG. 3 is similar to FIG. 1 illustrating the reclosable container lid including the slide lock closure engaged with the open-top container in an open position.

Referring to FIGS. 3 and 4, the slide lock closure 16 is configured to engage with the channel 34 to slide longitudinally along the channel 34 between a first position and a second position. As shown in FIG. 3, in the first position, the slide lock closure 16 opens the drinking spout 30. As shown in FIG. 4, in the second position, the slide lock closure 16 closes the drinking spout 30 to inhibit dispensing the contents of the container 12.

Figure 5:
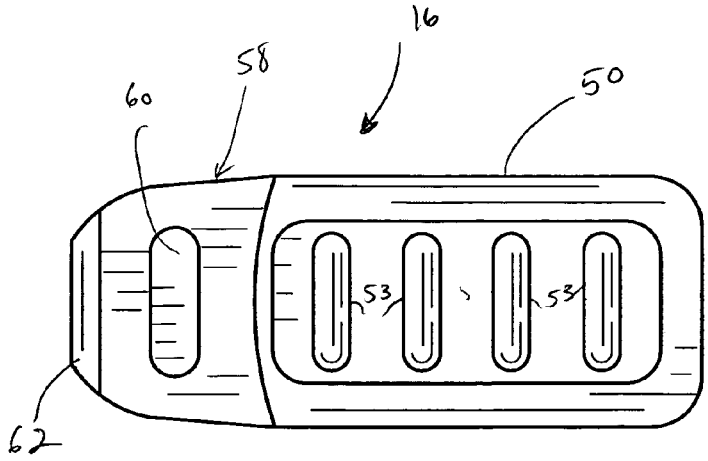
FIG. 5 is a plan view of the slide lock closure depicted in FIG. 1.
Figure 6:
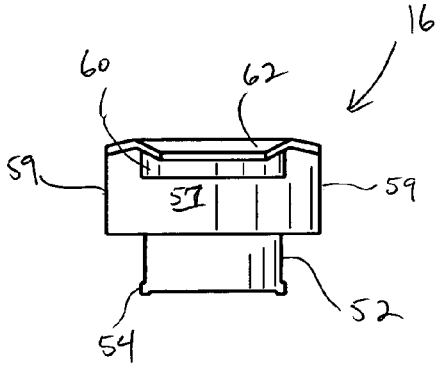
FIG. 6 is an end view of the slide lock closure depicted in FIG. 1
Figure 7:
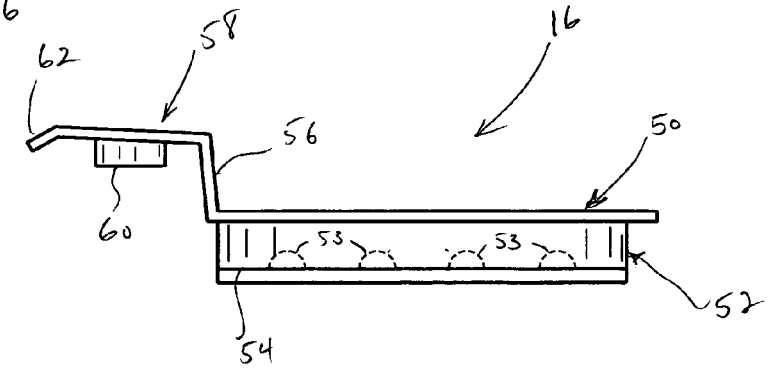
FIG. 7 is a side view of the slide lock closure depicted in FIG. 1.

Referring to FIGS. 5, 6 and 7, the slide lock closure 16 comprises a lower step segment 50 having a key 52 depending downwardly therefrom. The key 52 is suitably receivable by the channel 34 to permit movement of the slide lock closure 16 between the closed position and the opened position. The key 52 includes a pair of rail 54 spaced apart from one another and contacting the bottom surface 56 of the channel. The sides of the pair of rail 54 are configured to fit tightly with the pair of guideway 36 formed in the channel. Alternatively, the key 52 may include first and second angled surfaces (not shown) for mating with the first and second angled surface 56 of the channel 34, as shown in FIG. 2A, for retaining the key 52 in the channel 34. The lower step segment 50 includes a plurality of thumb pads 53 to assist a user to move the slide lock closure longitudinally along the channel. An upper step segment 58 is integrally connected to the lower step segment 50 by a resilient bridge 56. The bridge 56 has an arcuate surface 57 having side edges 59. To maintain a tight contact between the slide lock closure 16 and the cover 14, the side edges 59 of the bridge 56 sit in the pair of guideways 28 accordingly. The upper step segment 58 includes a plug 60 depending downwardly therefrom. The upper step segment 58 biases with respect to the lower step segment 50. The plug 60 is sealingly receivable by the drinking spout 30 in the cover 14 when the slide lock closure 16 is in the closed position as best depicted in FIG. 4. A tab 62 is depending downwardly from the upper step segment 58. When the slide lock closure 16 is in closed position, a user may push the tab 62 upwardly to open the drinking spout 30 and push away the slide lock closure 16 from the drinking spout 30 to facilitate drinking from the open-top container 12 by the user.

Figure 8:
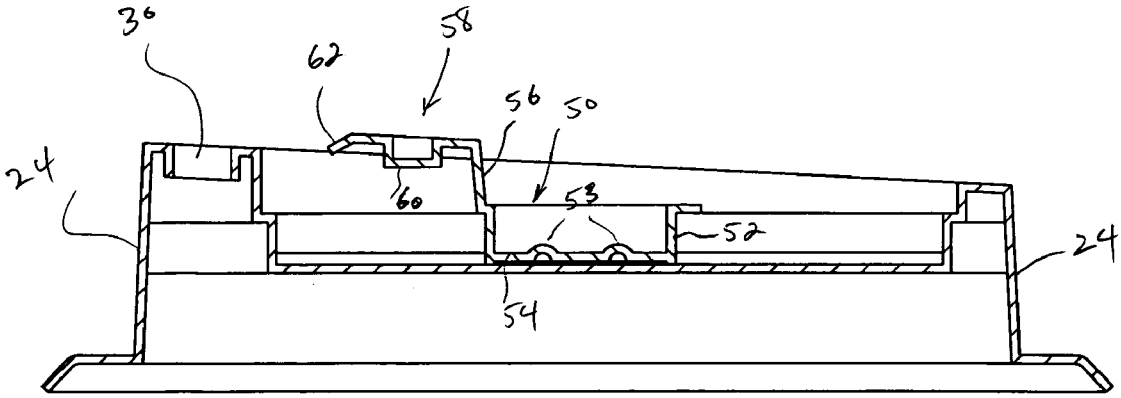
FIG. 8 is a sectional view of the lid taken along section lines 8-8 of FIG. 3 illustrating the slide lock closure in the opened position.
Figure 9:
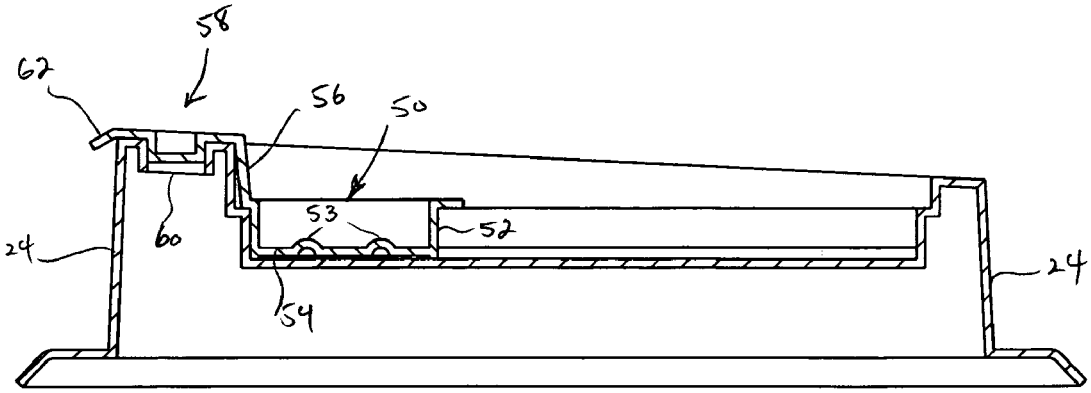
FIG. 9 is a sectional view of the lid taken along section lines 9-9 of FIG. 4 illustrating the slide lock closure in the closed.

FIGS. 8 and 9 depict the sectional views of the reclosable container lid 14 including the slide lock closure 16 in the opened and closed positions, respectfully. It should be noted that when the reclosable container lid is engaged with the open-top container 12, of the slide lock closure 16 and the side wall 24 of the cover 14 have nearly the same height with respect to one another. Therefore, this permits the bottom of the open-top container 12 positioned on the top wall 22. This aspect of the invention permits the enclosed open-top container 12 to be stacked on top of one another when the containers are filled with beverages during transportation. In addition, the drinking spout 30 is particularly dimensioned so that the plug 60 is sealingly received by the drinking spout 30 when the slide lock closure 16 is in the closed position.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A reclosable container lid comprising:

a cover including an annular top wall having a channel integrally formed therein, a drinking spout being defined by an opening in the top wall adapted to dispense the contents of the container, a side wall extending from the top wall, a lower portion of the side wall defining a mounting portion for sealingly attaching the lid to a container; and a slide lock closure comprises a lower step segment having a key depending downwardly therefrom, the key being suitably receivable by the channel of the lid to permit movement of the slide lock closure between an open position and a closed position, and an upper step segment integrally connected to the lower step segment by a resilient bridge having a plug depending downwardly therefrom, wherein the plug is sealingly receivable by the drinking spout in the lid when the slide lock closure is in the closed position.

2. The reclosable container lid of claim 1 the key is snap-fit into the channel for movement therealong.

3. The reclosable container lid of claim 1 wherein the channel includes at least one raised bump in the bottom surface thereof at a preselection position between a first end of the channel and a second end of the channel, wherein the key includes at least one ridge depending downwardly therefrom configured to engage the bump of the channel at the preselected position.

4. The reclosable container lid of claim 1 wherein the channel includes a plurality of raised bumps spaced apart along the bottom surface between the first end and second end such that the slide lock closure is lackingly positionable at each of the raised bump.

5. A reclosable container lid comprising:

a cover including an annular top wall having a channel integrally formed therein, a drinking spout being defined by an opening in the top wall adapted to dispense the contents of the container, a side wall extending from the top wall, a lower portion of the side wall defining a mounting portion for sealingly attaching the lid to a container; and a slide lock closure configured to engage with the channel to slide longitudinally along the channel between a first position and a second position wherein in the first position, the slide lock closure opens the drinking spout and wherein in the second position, the slide lock closure closes the drinking spout to inhibit dispensing the contents of the container and wherein the slide lock closure comprises a lower step segment having a key depending downwardly therefrom, the key being suitably receivable by the channel of the lid to permit movement of the slide lock closure between the closed position and the open position; and an upper step segment integrally connected to the lower step segment by a resilient bridge having a plug depending downwardly therefrom, wherein the plug is sealingly receivable by the drinking spout in the lid when the slide lock closure is in the closed position.

6. The reclosable container lid of claim 5 wherein the channel is formed in a central portion along the annular top wall.

7. The reclosable container lid of claim 5 wherein the cover comprises a raised rim being formed by the annular top wall and the side wall and wherein the drinking spout is disposed on the raised rim.

8. The reclosable container lid of claim 7 wherein the slide lock closure is adapted to fit over the raised rim when the slide lock closure is in the closed position.

9. The reclosable container lid of claim 5 wherein the key is snap-fit into the channel for movement therealong.

10. The reclosable container lid of claim 9 wherein the key includes at least a first angled surface for mating with a first angled surface of the channel for retaining the key in the channel for movement therealong.

11. The reclosable container lid of claim 10 wherein the key includes at least a second angled surface for mating with a second angled surface of the channel for retaining the key in the channel for movement therealong.

12. The reclosable container lid of claim 5 wherein the key includes a pair of rail spaced apart from one another and contacting a bottom surface of the channel.

13. The reclosable container lid of claim 12 wherein the channel includes a pair of guideway configured to receive the pair of rail.

14. The reclosable container lid of claim 5 wherein the lower step segment defines a thumb pad.

15. The reclosable container lid of claim 5 wherein the upper step segment is moveable relative to the lower step segment between the first position and the second position, and wherein the bridge biases the upper step segment towards the first position.

16. The reclosable container lid of claim 5 wherein the slide lock closure includes a downwardly-projecting free edge.

17. The reclosable container lid of claim 5 wherein the channel includes at least one raised bump in the bottom surface thereof at a preselection position between a first end of the channel and a second end of the channel, wherein the key includes at least one ridge depending downwardly therefrom configured to engage the bump of the channel at the preselected position.

18. The reclosable container lid of claim 17 wherein the channel includes a plurality of raised bumps spaced apart along the bottom surface between the first end and second end such that the slide lock closure is lockingly positionable at each of the raised bump.

19. A reclosable container lid comprising:

a cover including an annular top wall having a channel integrally formed therein, a drinking spout being defined by an opening in the top wall adapted to dispense the contents of the container, a side wall extending from the top wall, a lower portion of the side wall defining a mounting portion for sealingly attaching the lid to a container, a raised rim being formed by the annular ton wall and the side wall; and a slide lock closure configured to engage with the channel to slide longitudinally along the channel between a first position and a second position wherein in the first position, the slide lock closure opens the drinking spout and wherein in the second position, the slide lock closure closes the drinking spout to inhibit dispensing the contents of the container and wherein the slide lock closure is adapted to fit over the raised rim when the slide lock closure is in the closed position wherein the slide lock closure comprises a lower step segment having a key depending downwardly therefrom, the key being suitably receivable by the channel of the lid to permit movement of the slide lock closure between the closed position and the open position; and an upper step segment integrally connected to the lower step segment by a resilient bridge having a plug depending downwardly therefrom, wherein the plug is sealingly receivable by the drinking spout in the lid when the slide lock closure is in the closed position.

20. The reclosable container lid of claim 19 wherein the key is snap-fit into the channel for movement therealong.

21. The reclosable container lid of claim 20 wherein the key includes at least a first angled surface for mating with a first angled surface of the channel for retaining the key in the channel for movement therealong.

22. The reclosable container lid of claim 21 wherein the key includes at least a second angled surface for mating with a second angled surface of the channel for retaining the key in the channel for movement therealong.

23. The reclosable container lid of claim 19 wherein the key includes a pair of rail spaced apart from one another and contacting a bottom surface of the channel.

24. The reclosable container lid of claim 23 wherein the channel includes a pair of guideway configured to receive the pair of rail.

25. The reclosable container lid of claim 19 wherein the lower step segment defines a thumb pad.

26. The reclosable container lid of claim 19 wherein the upper step segment is moveable relative to the lower step segment between the first position and the second position, and wherein the bridge biases the upper step segment towards the first position.

27. The reclosable container lid of claim 19 wherein the slide lock closure includes a downwardly-projecting free edge.

28. The reclosable container lid of claim 19 wherein the channel includes at least one raised bump in the bottom surface thereof at a preselection position between a first end of the channel and a second end of the channel, wherein the key includes at least one ridge depending downwardly therefrom configured to engage the bump of the channel at the preselected position.

29. The reclosable container lid of claim 28 wherein the channel includes a plurality of raised bumps spaced apart along the bottom surface between the first end and second end such that the slide lock closure is lockingly positionable at each of the raised bump.

30. The reclosable container lid of claim 19 wherein the channel is formed in a central portion along the annular top wall.

* * * * *